United States Patent [19]

Bauerschmidt

[11] 4,126,205

[45] Nov. 21, 1978

[54] AUTOMOBILE EXHAUST GAS MUFFLER CONSTRUCTION

[75] Inventor: Walter Bauerschmidt, Kirchheim-Ötlingen, Germany

[73] Assignee: J. Eberspächer, Germany

[21] Appl. No.: 778,474

[22] Filed: Mar. 17, 1977

[30] Foreign Application Priority Data

Mar. 24, 1976 [DE] Fed. Rep. of Germany ..... 2612421

[51] Int. Cl.[2] ..... F01N 1/10

[52] U.S. Cl. ..... 181/256; 181/272; 181/279

[58] Field of Search ..... 181/279, 280, 256, 274, 181/272

[56] References Cited

U.S. PATENT DOCUMENTS

| | | | |
|---|---|---|---|
| 2,241,010 | 5/1941 | Chipley | 181/272 |
| 3,371,472 | 3/1968 | Krizman | 181/279 X |
| 3,692,142 | 9/1972 | Stemp | 171/256 |

FOREIGN PATENT DOCUMENTS

| | | | |
|---|---|---|---|
| 473,812 | 3/1929 | Fed. Rep. of Germany | 181/279 |
| 2,227,808 | 11/1974 | France | 181/279 |

*Primary Examiner*—Donald G. Kelly
*Attorney, Agent, or Firm*—McGlew and Tuttle

[57] ABSTRACT

An automobile exhaust gas muffler construction for flowing exhaust gases, comprises a housing having spaced apart semi-cylindrical end walls interconnected by tangential straight side walls. The housing also includes a front wall having a tubular inlet extending therethrough and through at least a portion of the housing, and a rear wall with a tubular outlet extending through the rear wall and through at least a portion of the housing. The tubular inlet and tubular outlet each have a gas flow slot passage defined along its length within the housing and gases flow from the inlet through this slot in the housing and through spiral passages defined by sound-muffling walls. The spiral passages of the inlet communicate with an expansion chamber defined in the housing which, in turn, communicates with spiral passages defined around the outlet connection.

8 Claims, 6 Drawing Figures

AUTOMOBILE EXHAUST GAS MUFFLER CONSTRUCTION

FIELD AND BACKGROUND OF THE INVENTION

This invention relates in general to the construction of mufflers for flowing gases and, in particular, to a new and useful automobile exhaust gas muffler construction in which the housing has two semi-cylindrical end wall portions which are centered in respect to a respective tubular inlet and outlet which extend through a respective front and rear wall of the housing and which communicate together by a spiral passage arranged around each tubular inlet and outlet and by an interconnecting expansion chamber.

DESCRIPTION OF THE PRIOR ART

The present invention relates to an improved muffler construction over that shown and disclosed in Canadian Pat. No. 946,692, wherein, the inlet pipe connection extends through a single front wall, since only one exhaust gas inlet pipe is provided. In view of its size and shape, this device of the prior art is unsuitable for mounting in vehicles, that is, a housing having a circular cross-section requires a large clear height which is usually not available. This limits the number of spiral channels arranged one over another and, consequently, also limits the sound-absorbing effect. At the same time, a disadvantage of this construction is that the outlet connection is provided laterally, so that it must be bent in order to be able to connect an exhaust pipe which ordinarily extends in parallel to the axis of the housing. Accordingly, the mounting of the device is also expensive.

In the device disclosed in U.S. Pat. No. 3,692,142, the centrally provided gas inlet connection does not extend into the housing, so that an unfavorable flow is obtained upstream of the spiral channels. In addition, by means of helical guide surfaces having no sound-absorbing effect, these spiral channels are connected to a conically narrowed outlet space to which the centrally aligned gas outlet pipe is connected. This device of the prior art is also unsuitable for being mounted in vehicles due to its size and shape and, in addition, the sound absorbing effect is limited in proportion to the constructional costs.

SUMMARY OF THE INVENTION

The present invention is directed to a muffler which requires less space and primarily less height than the known devices, in proportion to the desired high sound-absorbing effect and, at the same time, provides favorable conditions for connecting an inlet and outlet pipe and thus for being mounted in a vehicle. As a matter of course, the occuring gas flow losses and, thereby, the back pressure of the engine are minimized, and the construction is suitable for economical mass production.

In accordance with the invention, this problem is solved in a progressive manner by providing the features recited in the characterizing part of claim 1. Due to the provision of two spiral channels which are disposed adjacent each other and connected in series, the height of the housing can be made very small. For mounting in vehicles, it is further convenient that the inlet and outlet connections extend in parallel to the axis of the housing. Because of the resulting good guidance through the channels, the flow losses and, consequently, the back pressure of the engine are small. Since the channels are made sound-absorbing throughout, the muffling effect in proportion to the size of the device is surprisingly high. Finally, the device is composed of parts which are easy to manufacture and assemble and is thus suitable for economical mass production.

In a further development of the invention, the two series-connected spiral channels are disposed side-by-side, with the axes of the spirals parallel to each other, and an expansion chamber, which may be particularly desirable, is formed therebetween.

In another embodiment of the invention, two series-connected spiral channels have the axes of their spirals aligned with each other and their length or the length of the sound-absorbing path may be increased to any desired extent by enlarging the axial spacing of the connection pipes relative to each other, without having to change the small height of the housing.

Accordingly, it is an object of the invention to provide a muffler construction for flowing exhaust gases which includes a housing having semi-cylindrical end wall portions interconnected by tangentially interconnecting side walls and which includes a tubular inlet connected into one end of the housing and centered in respect to a semi-cylindrical wall portion and a tubular outlet connected into the opposite end of the housing and centered in respect to the other tubular wall portion, and wherein, the flowing gases flow through a slot of the tubular connection within the housing through sound-dampened spiral passages and to a central expansion chamber which communicates with a similar spiral passage for the tubular outlet which is centered in respect to the other semi-cylindrical housing portion.

A further object of the invention is to provide a muffler construction which includes a tubular inlet extending into one side of the housing and a tubular outlet extending into another side constructed so as to permit easy assembly and mounting of the device within an automobile vehicle.

A further object of the invention is to provide an automobile exhaust gas muffler construction which is simple in design, rugged in construction and economical to manufacture.

The various features of novelty which characterize the invention are pointed out with particularity in the claims annexed to and forming a part of this disclosure. For an understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
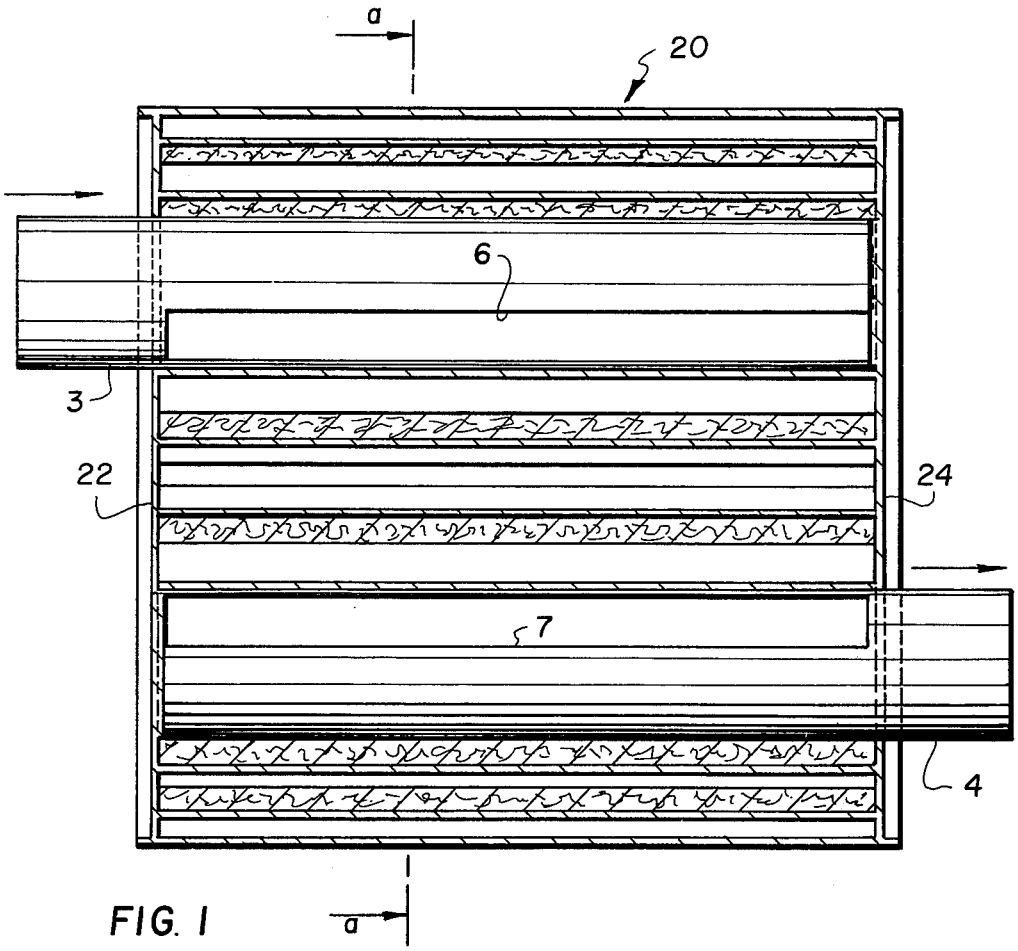
FIG. 1 is a longitudinal sectional view of a muffler constructed in accordance with the invention.
Figure 1A:
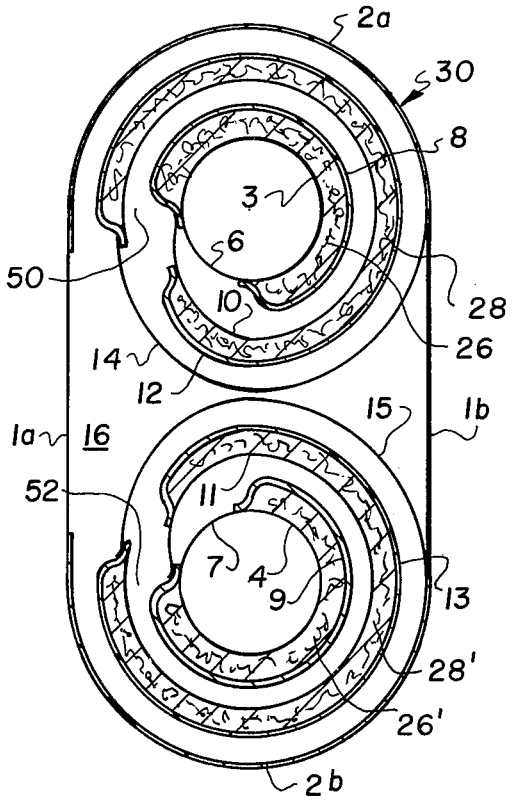
FIG. 1*a* is a sectional view taken along the line *a—a* of FIG. 1.

Referring to the drawings in particular, the invention embodied therein in FIGS. 1 and 1*a* comprises an exhaust gas muffler for automobile vehicles which includes a housing 20 of a muffler which is formed by two parallel flat side walls 1*a* and 1*b*, and two semi-cylindrical end walls or semi-cylinders 2*a* and 2*b*. Coaxially of each of the semicylinders 2*a* and 2*b*, an inlet pipe connection 3 is secured to a front wall 22 of the housing and an outlet pipe connection 4 is secured to a rear wall 24. Both connections extend through the housing 20 up to the opposite wall. The connections 3 and 4 are provided with longitudinal slots 6 and 7, respectively, which extend over the entire length of the connection within the housing and which opens into a channel formed by walls spirally extending over one another. For this purpose, the circumferential surface area outside the slot of both the inlet and the outlet pipe connections is enveloped by sound-muffling wall means including sound-absorbing layers 26, 26' which, in turn, are covered by perforated walls 8 and 9, respectively. Non-perforated walls 10 and 11 are spaced from and surround the slots 6 and 7 and the perforated walls 8 and 9, respectively, and, in turn, they are enveloped by sound-absorbing layers 28, 28' which are covered by a respective perforated wall 12, 13. Walls 12 and 13 are again followed by non-perforated walls 14 and 15, respectively. Walls 14 and 15 are spaced from and surround perforated walls 12, 13 and, finally, they meet with the inner circumferential surface of the semi-cylindrical part of the housing.

Spirally extending gas flow channels 50 and 52 which are defined by the sound-muffling wall means terminate in an expansion chamber 16 provided in the housing between the channels. Due to the sound-absorbing layers provided behind the perforated walls, the sound pressure of the gas flowing through the channels is considerably reduced.

Figure 2:
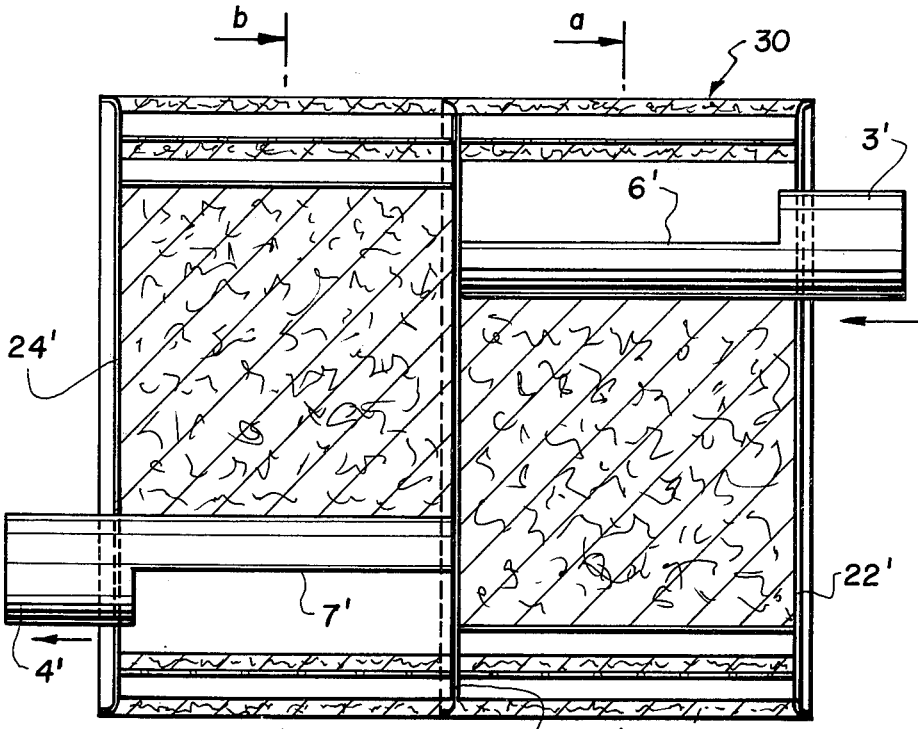
FIG. 2 is a view similar to FIG. 1 of another embodiment of the inventive muffler in which the spiral channels are disposed in axial alignment with each other.

In the embodiment of FIG. 2, a muffler housing 30 is formed also by two parallel flat walls 1*a'*, 1*b'*, and two semi-cylindrical walls 21', 2*b'*. Coaxially of each of the semi-cylinders, an inlet pipe connection 3' and an outlet pipe connection 4' is secured to the respective front and rear walls 22' and 24' of the housing 30, and each of the connections extends up to an inner cross-wall or partition 5. As in the first embodiment, each of the connections is provided with a longitudinal slot 6', 7' extending over the entire length of the connection within the housing up to the partition 5. From the surface area outside the slot of each pipe connection 3', 4', parallel perforated walls 17', 18' extend into the housing and are tangent to the circumference of the respective pipe connections 3' and 4' and enclose a sound-absorbing layer 32 located therebetween. Walls 17' and 18' terminate in semi-cylindrical walls 17*a*, 18*a*, which are aligned with the respective pipe connections 3' and 4'. For forming a spirally extending channel, walls 17', 17*a*, 18' and 18*a*, as well as longitudinal slots 6' and 7', are surrounded by non-perforated walls 19, 20, spaced therefrom. Walls 19, 190 are surrounded by perforated walls 21, 210, with the interposition of a sound-absorbing layer 34, and is followed by another non-perforated wall 23 which is spaced from and surrounds walls 21, 210 and is separated from the inner wall of the housing by a sound-absrobing layer 36. In the transition zone, where walls 19, 190 and 23 join, inner cross-wall 5 is provided, adjacent the housing wall, with an opening 240 providing an expansion chamber 25 and convenient flow passage for the gas passing from a spiral inlet flow passage 50' to a spiral outlet flow passage 52'.

The sound-absorbing layer means defined by the perforated walls and sound-absorbing material serves, in addition, as a thermal insulation toward the outside. The sound-absorbing effect along the flow channels can be influenced by providing various thicknesses of the sound-absorbing layers between the perforated and non-perforated walls. The progressive gas expansion may be supported by varying the clear width of the flow channels, for example, by enlarging them gradually.

All of the walls are made of sheet metal, which can be easily bent to the desired shape. The sheets are connected to each other, preferably, by welding which, in view of the described structure of the device, may be done without difficulty. The front walls and, if provided, the inner cross-wall 5 are preferably pot-shaped and upon assembly, their flanges are engaged from the outside by the walls of the housing.

Figure 2C:
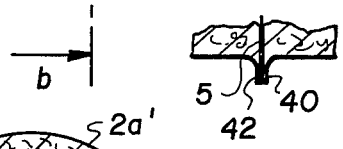
FIG. 2*c* is a partial enlarged detail of FIG. 2.
Figure 2B:
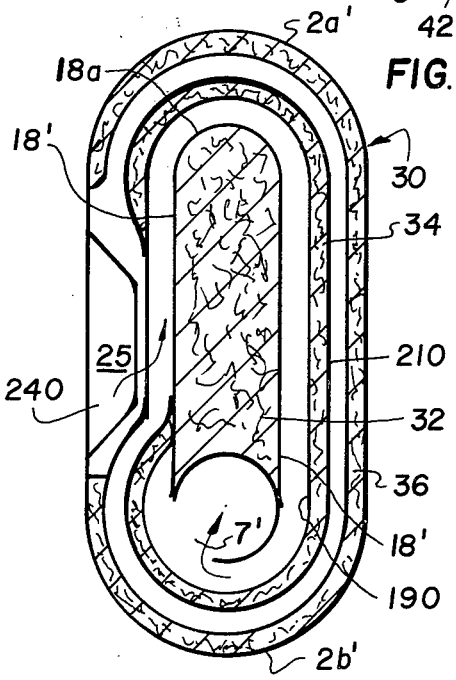
FIG. 2*b* is a sectional view taken along the line *b—b* of FIG. 2.
Figure 2A:
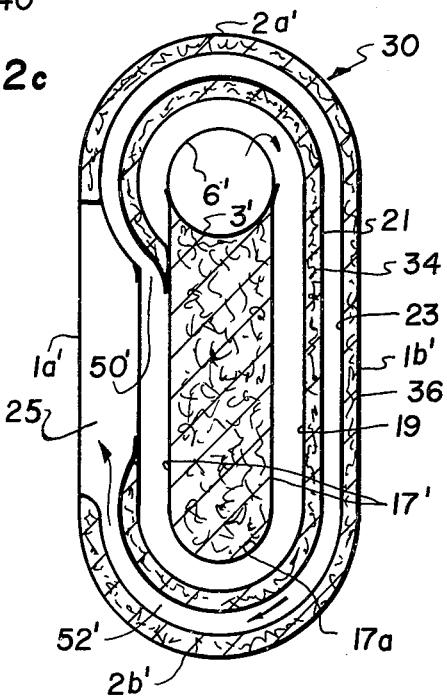
FIG. 2*a* is a sectional view taken along the line *a—a* of FIG. 2.

However, as shown in FIG. 2*c*, it is also possible to provide a flat inner cross-wall 5 and to insert it between radial flanges 40 and 42 of separate parts of the housing.

While specific embodiments of the invention have been shown and described in detail to illustrate the application of the principles of the invention, it will be understood that the invention may be embodied otherwise without departing from such principles.

What is claimed is:

1. An automobile exhaust gas muffler construction for flowing exhaust gases, comprising a housing having spaced apart semi-cylindrical end walls, substantially straight side walls tangentially interconnecting said end walls, and front and rear walls, and a tubular inlet connection for the inflow of gases into said housing secured to and extending into said housing front wall and through at least a portion of said housing and having a first flow passage slot extending along at least a portion of said inlet length within said housing, a tubular outlet connection for the outflow of gases from said housing secured to and extending into said rear wall and through at least a portion of said housing having a second flow passage slot extending along said outlet length within said housing, first and second sound-muffling wall means within said housing extending around and spaced from said tubular inlet and said tubular outlet, respectively, and overlying respective first and second slot passages and defining respective first and second spiraling gas passages communicating with respective said first and second flow passage slots and extending around said tubular inlet and said tubular outlet, respectively, and an expansion chamber defined in said housing between said first and second gas passages and providing a gas flow communication between said first and second spiraling gas passages.

2. An automobile exhaust gas muffler construction, according to claim 1, wherein said sound-muffling wall means comprises at least one wall having a sound-absorbing layer and a perforated covering wall.

3. An automobile exhaust gas muffler construction, according to claim 1, wherein there are a plurality of spaced apart walls defining said spiral gas passage around respective said tubular inlet and said tubular outlet, said tubular inlet and said tubular outlet being arranged concentrically with respect to said semi-cylindrical end walls of said housing, said sound-muffling wall means including a continuous non-perforated wall spiraling outwardly from said slot passage around said respective tubular inlet and tubular outlet terminating in the associated cylindrical end wall of said housing and a sound-absorbing layer covering a portion of the exterior of said non-perforated wall and including a perforated wall covering said sound-absorbing material.

4. An automobile exhaust gas muffler construction, according to claim 1, including a partition wall dividing said housing, said tubular inlet and said tubular outlet terminating at said partition wall, said partition wall having an opening therethrough at the location of said expansion chamber.

5. An automobile exhaust gas muffler construction, according to claim 1, wherein said tubular inlet and said tubular outlet are centered in respect to respective semi-cylindrical end walls of said housing, said sound-muffling wall means defining successive spiral passages around respective said tubular inlet and said tubular outlet and including a non-perforated wall and a perforated cover wall with a sound-absorbing layer of material therebetween of substantially uniform thickness between successive spiral passage portions.

6. An automobile exhaust gas muffler construction, according to claim 1, wherein said sound-muffling wall means define a plurality of successive spiral passages around each of said tubular inlet and said tubular outlet, each of said passages having equal heights.

7. An automobile exhaust gas muffler construction, according to claim 1, wherein said front and rear walls are pot-shaped.

8. An automobile exhaust gas muffler construction, according to claim 1, including a partition extending through said housing between said front and rear walls, each of said tubular inlet and said tubular outlet terminating at said partition, said housing including a portion on each side terminating in a flange abutting against said partition.

* * * * *